United States Patent [19]

Frechette

[11] 4,408,913

[45] Oct. 11, 1983

[54] INKED RIBBON CARTRIDGE RIBBON WITH SUPPLY SPOOL DRAG DEVICE

[75] Inventor: Thomas E. Frechette, Windsor Locks, Conn.

[73] Assignee: Royal Business Machines, Inc., Windsor, Conn.

[21] Appl. No.: 350,818

[22] Filed: Feb. 22, 1982

[51] Int. Cl.[3] ..... B41J 35/28

[52] U.S. Cl. ..... 400/208; 400/234; 242/75.4

[58] Field of Search ..... 400/194, 195, 196, 196.1, 400/207, 208, 208.1, 227.2, 236.1, 234, 247; 242/75.4, 75.41, 192, 197, 198, 199

[56] References Cited

U.S. PATENT DOCUMENTS

| | | | |
|---|---|---|---|
| 734,660 | 7/1903 | Bellamy | 400/194 X |
| 766,804 | 8/1904 | Bellamy | 400/194 X |
| 876,454 | 1/1908 | Heuser | 400/234 X |
| 3,877,561 | 4/1975 | Guerrini et al. | 400/208 |
| 4,034,935 | 7/1977 | Plaza et al. | 242/197 |

*Primary Examiner*—Edgar S. Burr
*Assistant Examiner*—Charles A. Pearson
*Attorney, Agent, or Firm*—Joseph R. Spalla

[57] ABSTRACT

An ink ribbon cartridge is provided with means to control ribbon tension which takes the form of an O-ring driven by the supply spool which is trained around a drag post. When ribbon is to be drawn from the supply spool as by ribbon feed mechanism operative incident to a print action, the rotation of the supply spool is resisted by the drag or friction between the O-ring and the post. The drag force to be overcome to rotate the supply spool is low and does not vary significantly from full to empty supply spool. The resilience of the O-ring also stores energy which acts oppositely on the supply spool when the force to draw off ribbon is removed.

4 Claims, 2 Drawing Figures

Fig_1
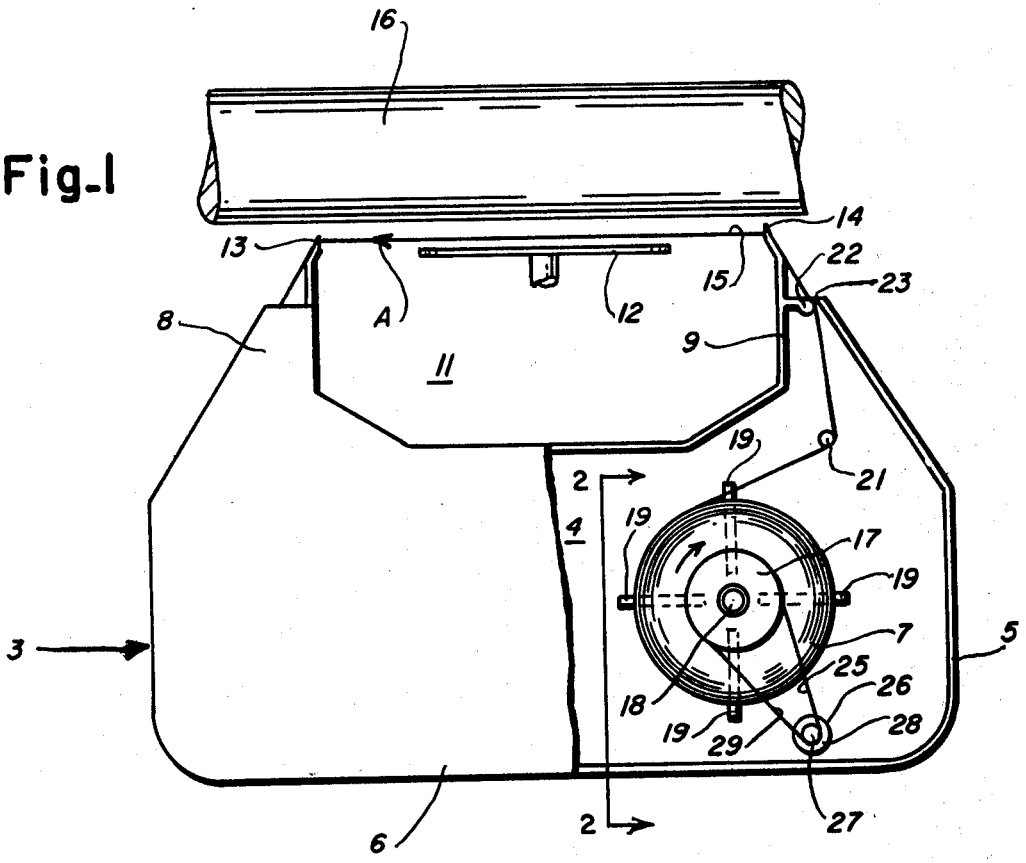
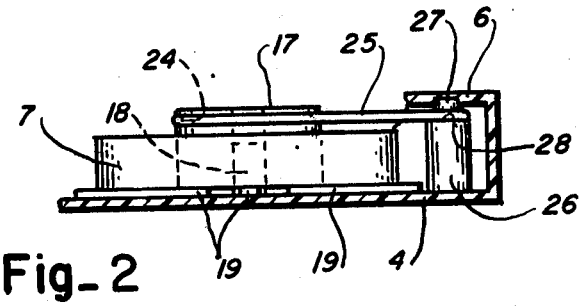
Fig_2

INKED RIBBON CARTRIDGE RIBBON WITH SUPPLY SPOOL DRAG DEVICE

This invention relates to inked ribbon cartridges and to a ribbon tension control member to prevent overthrow of the supply spool when ribbon is drawn off therefrom yet allow spool rotation incident to applied force as to minimize the applied force thereby avoiding jams and/or breakage of ribbon. More particularly, the ribbon tension control member is characterized by an elastic O-ring trained about the supply spool hub and about a drag post. The forces required to overcome the friction at the drag post are low yet sufficient to resist overthrow, and do not vary significantly as supply spool diameter decreases.

Ink ribbon cartridges known to the prior art have employed a variety of supply spool drag devices to control ribbon tension. Among them are those responsive to a pre-determined ribbon tension to release the supply spool for rotation until ribbon tension decreases and the hub is reengaged. The sudden release is a shortcoming which may cause the ribbon to momentarily lose tension. Others exert a friction drag force acting on the supply spool hub or periphery which resists supply spool rotation until the applied forces for pulling ribbon from the supply spool exceeds the resisting drag force. If the forces resisting spool rotation and which must be overcome by applied force are too high, ribbon breakage due to excessive tension could result, particularly where relatively weak one-time ribbons are used. Were multi-strike ribbons which might withstand breakage due to high tension are used, jams could result when ribbon tension is excessive. In all, the change in geometry due to decreasing supply spool diameters requires high initial and increasingly higher applied forces which vary significantly.

In accordance with the invention, an elastic O-ring is trained about a groove in a supply spool hub and about a smaller radius drag post. The O-ring diameter relative to the centerline distance between hub and post is such that the mounted O-ring will be only minimally stretched and will be in sufficient frictional engagement with the supply hub to be driven without slippage when the supply spool hub is caused to rotate by applied pulling forces on the ribbon higher than the frictional resistance to movement of the O-ring by the drag post. The initial drag of the O-ring and post is sufficient to maintain ribbon tension by resisting spool rotation but allows spool rotation with a low pulling force which does not significantly increase as spool diameter decreases. The force required to overcome drag with a full supply spool need only be on the order of 10 grams increasing only to on the order of 12 grams when approaching the empty spool state. The O-ring drag force also precludes overthrow as might occur due to the mass of a full supply spool. The resilience of the O-ring also stores energy during spool rotation and applies the stored energy oppositely when the ribbon pull force is removed thereby to maintain constant ribbon tension. Thus the supply spool is never released; the O-ring retains full control of the supply spool at all times.

An object of the invention is to provide an inked ribbon cartridge having a supply spool drag device which does not require high applied pulling forces to withdraw ribbon from a supply stool yet which resists overthrow of the supply spool due to accelerating ribbon pulling forces and to its own momentum.

Another object of the invention is to provide a supply spool drag device whose resistance to supply spool rotation is low and relatively constant over the full range of supply spool diameters.

Other objects, features and advantages of the present invention will become known to those skilled in the art from a reading of the following detailed description when taken in conjunction with the accompanying drawing wherein like reference numerals designate like or corresponding parts throughout the several views thereof, and wherein:

FIG. 1 is a plan view of an inked ribbon cartridge with cover portions removed; and FIG. 2 is a view taken along lines 2—2′ of FIG. 1.

Referring now to the drawing, there is shown in FIG. 1 an inked ribbon cartridge generally designated by reference numeral 3 having integrally molded bottom 4 and side walls 5 to which a cartridge cover 6 is secured as by snap in pins in the cover and by mating holes in the bottom side walls (not shown). The cartridge 3 defines a housing for a ribbon supply spool 7 and a ribbon take up spool to be driven by machine mechanism (not shown). The cartridge 3 also defines spaced arms 8, 9 extending outwardly from the housing to provide a gap 11 for a printing element, e.g., a print wheel 12. Guides 13 and 14 on the extremities of the spaced arms guide a ribbon 15 extending from the supply spool 7 in the direction of arrow A across the gap 11 between the printer element 12 and a platen 16 and into the cartridge 3 for takeup as will be understood in the art.

As shown in FIG. 1 the ribbon supply spool 7 has a hollow hub or core 17 which is rotatably supported on a post 18 extending from the bottom wall 4 of the cartridge 3 and which is supported above the bottom wall 4 of the cartridge by ribs 19.

Still with reference to FIG. 1 a ribbon guide post or roller 21 and a guide post 22 are formed with and extend from the bottom 4 and side walls 5 of the cartridge 3 to guide ribbon 15 drawn off from the supply spool 7 through an exit aperture 23 in arm 9 of the cartridge 3. Ribbon 15 is incrementally drawn off the the supply spool 7 by a pulling force, acting in arrow direction A, exerted by the ribbon take-up means (not shown) which is operative incident to each print action.

As shown in FIG. 1 and with reference to FIG. 2 in particular, the supply spool core 17 at its upper end is formed with a peripheral groove 24 to retain an O-ring 25 of elastic material which is also trained about a post 26 extending vertically from the bottom wall 4. The upper end 27 of the post 26 is significantly smaller in diameter than that of the supply spool core 17. The upper end 27 is also preferably slightly smaller in diameter than that of the post 26 thereby to form a shoulder 28 to preclude, in cooperation with the underside of the cover into which the end 27 extends, any tendency of the O-ring 25 to vertically creep. The O-ring 25 is dimensioned so that when mounted it is stretched only minimally to frictionally engage the groove 24 and the upper end of the post 26.

As ribbon 15 is pulled by the ribbon take up means (not shown) ribbon tension will increase until the drag on the supply spool 7, exerted by the frictional drag of the post 26 resisting movement of the O-ring 25 and consequently rotation of the supply spool, is exceeded; rotation of the supply spool 7 in turn driving the O-ring 25 around the drag post 26. During driving movement, the O-ring 25 will store energy as by stretching the run 29 extending from the post 26 to the spool core 17. The stored energy, when the pulling force on the ribbon 15 ceases, will act oppositely on the supply spool 7 to maintain ribbon tension.

As will be appreciated, the pulling forces on the ribbon 15 necessary to overcome the frictional drag of the post 26 resisting O-ring movement and supply spool rotation is minimal at all spool diameters on the order of 10 grams with full spool and increasing only to 12 grams with decreasing spool diameter to an empty spool condition. These forces are below those as would subject even one-time ribbon to breaking tension. As will be evident, the O-ring 25 is always in control; it never releases the supply spool 7 as would allow it to unwind uncontrolled by its momentum with consequent loss of ribbon tension.

The invention claimed is:

1. An inked ribbon cartridge rotatably supporting supply and take-up spools adapted to be mounted on a typewriter or like machine, said cartridge having exit and entry apertures to permit ribbon to be incremently drawn off said supply spool onto said take-up spool incident to print actions with a length of ribbon between exit and entry apertures exposed to a printing element, said supply spool having a core on which ribbon is wound, said supply spool being rotatable about a post, said core having an axial length greater than the width of the ribbon wound thereon whereby a terminal portion of its length extends beyond said wound ribbon, a circumferential groove in said terminal core portion, a fixed drag post in said cartridge extending parallel to the axis of said supply spool core and spaced therefrom a distance exceeding the radius of a fully wound supply spool, said drag post being fixed against both translational and rotational movement relative to said post, and a stretched O-ring of resilient material mounted in said groove and trained about said drag post.

2. An inked ribbon cartridge so recited in claim 1, said drag post diameter being less than that of the spool core.

3. An inked ribbon cartridge as recited in claim 2, said mounted O-ring being stretched to be frictionally driven without slippage by said supply spool and to slip relative to said drag post when the supply spool is rotated by a given ribbon pulling force in excess of the frictional drag force between said O-ring and drag post, said drag force being substantially constant from full to empty supply spool.

4. An inked ribbon cartridge as recited in claim 1, said cartridge having top and bottom walls, said drag post extending from the bottom wall having a reduced upper position for reception in a receiving hole in said top wall, and said O-ring being trained about said reduced upper portion of said drag post and retained between the shoulder formed by said reduced portion and said cartridge top wall in a plane containing said circumferential groove in the supply spool core.

* * * * *